US010921022B2

(12) United States Patent
Giannoulis

(10) Patent No.: US 10,921,022 B2
(45) Date of Patent: Feb. 16, 2021

(54) HEATING DEVICE

(71) Applicant: Stylianos Giannoulis, Salonika (GR)

(72) Inventor: Stylianos Giannoulis, Salonika (GR)

( * ) Notice: Subject to any disclaimer, the term of this patent is extended or adjusted under 35 U.S.C. 154(b) by 274 days.

(21) Appl. No.: 14/994,648

(22) Filed: Jan. 13, 2016

(65) Prior Publication Data

US 2016/0209078 A1 Jul. 21, 2016

(30) Foreign Application Priority Data

Jan. 15, 2015 (EP) ..... 15151236

(51) Int. Cl.

| | |
|---|---|
| ***F24H 3/04*** | (2006.01) |
| ***F24H 9/18*** | (2006.01) |
| ***H05B 1/02*** | (2006.01) |
| ***H05B 3/50*** | (2006.01) |
| *F28F 1/24* | (2006.01) |
| *F28F 1/12* | (2006.01) |

(52) U.S. Cl.

CPC ..... *F24H 3/0411* (2013.01); *F24H 3/0405* (2013.01); *F24H 9/1863* (2013.01); *H05B 1/0236* (2013.01); *H05B 3/50* (2013.01); *F24H 2250/14* (2013.01); *F28F 1/126* (2013.01); *F28F 1/24* (2013.01); *H05B 2203/023* (2013.01); *H05B 2203/032* (2013.01)

(58) Field of Classification Search

CPC ..... F24H 3/002; F24H 9/0063; F24H 3/0405
USPC ..... 392/354, 375, 376, 377, 378; 165/130, 165/131; 219/374, 367, 368, 382, 532, 219/530

See application file for complete search history.

(56) References Cited

U.S. PATENT DOCUMENTS 1,327,870 A * 1/1920 Lange ..... F28D 1/05358 165/130
1,367,023 A * 2/1921 Curran ..... F28D 1/0308 165/130
1,368,318 A * 2/1921 Bassler ..... F28D 1/05341 165/130
1,371,031 A * 3/1921 Kellogg ..... F28D 1/0246 165/130
1,542,085 A * 6/1925 Persson ..... F28F 21/088 165/130
1,607,171 A * 11/1926 Sage ..... F28D 1/05333 165/130

(Continued)

FOREIGN PATENT DOCUMENTS

DE 202006017352 U1 1/2007
GB 167507 A 8/1921

(Continued)

*Primary Examiner* — Jimmy Chou

(74) *Attorney, Agent, or Firm* — Schmeiser, Olsen & Watts, LLP

(57) ABSTRACT

A heating device including: a housing having an opening and surrounding an interior space. A fan is arranged in proximity to the housing. A heating element is arranged in the housing, and a heat distribution element arranged in the housing and in proximity to the heating element. The heating element is adapted to generate heat. The heat distribution element is adapted to transfer the heat generated by the heating element to air in the interior space, and the fan is adapted to provide a flow of air through the interior space of the housing such that the air is heated. The heated air leaves the housing through the opening.

12 Claims, 15 Drawing Sheets

(56) References Cited

U.S. PATENT DOCUMENTS 1,620,769 A * 3/1927 Lamblin ..... B64D 33/10 123/41.48
1,635,656 A * 7/1927 Beyer ..... F28D 1/05366 165/130
1,703,572 A * 2/1929 Carlberg ..... F28D 1/03 123/61 V
1,723,406 A * 8/1929 Carmean ..... F24H 3/0417 219/532
1,731,472 A * 10/1929 Murray ..... F24H 3/002 165/129
1,737,251 A * 11/1929 Kuenstler ..... F28D 1/0246 165/130
1,757,534 A * 5/1930 Lindstrom ..... F28F 21/088 165/130
1,795,044 A * 3/1931 Rundlett ..... B60H 1/08 165/130
1,816,111 A * 7/1931 De Ferranti ..... H01F 27/12 165/104.33
1,879,889 A * 9/1932 Ballentine ..... F24H 3/002 219/540
1,897,113 A * 2/1933 Doucet ..... F28D 1/0325 165/130
1,910,105 A * 5/1933 Herring ..... F28D 1/0477 165/130
1,951,968 A * 3/1934 Deutsch ..... F28F 9/266 165/130
1,975,957 A * 10/1934 Kuenstler ..... F28D 1/0246 165/130
1,986,814 A * 1/1935 Hartman ..... B01D 53/0454 392/485
2,191,519 A * 2/1940 Cornell, Jr. ..... F24F 1/01 165/123
2,230,440 A * 2/1941 Wiegand ..... F24H 3/002 165/181
2,651,506 A * 9/1953 Ernst ..... F28F 21/088 165/130
2,692,762 A * 10/1954 Samuel ..... F24D 19/0095 165/130
2,814,433 A * 11/1957 Brinen ..... F04D 29/526 415/210.1
2,877,000 A * 3/1959 Person ..... F28D 1/0316 165/159
2,980,402 A * 4/1961 Lundstrum ..... F28D 1/053 165/96
3,061,706 A 10/1962 Dillard
3,127,106 A * 3/1964 Giroud ..... F24D 19/0082 165/130
3,217,139 A * 11/1965 Barber ..... H05B 3/009 392/411
3,396,458 A * 8/1968 Eberhard ..... B21C 37/202 165/183
3,605,882 A * 9/1971 Smith et al. ..... F28F 9/0231 165/104.32
4,036,287 A * 7/1977 Perani ..... F28D 1/0246 165/55
4,103,146 A 7/1978 Rampe
4,151,398 A * 4/1979 Maake ..... F24H 3/0405 219/532
4,212,350 A * 7/1980 Andreoli ..... F28D 1/024 165/129
4,657,070 A * 4/1987 Kluppel ..... F28B 1/06 165/110
4,730,551 A * 3/1988 Peludat ..... F24F 3/1603 454/233
4,900,898 A * 2/1990 Kling ..... F24H 3/0405 392/503
5,078,574 A * 1/1992 Olsen ..... F04D 19/002 415/182.1
5,285,719 A * 2/1994 McFadden ..... A21B 1/26 126/21 A
5,341,455 A * 8/1994 de' Longhi ..... F28D 1/0233 165/130
5,404,652 A 4/1995 Sher
5,685,365 A * 11/1997 De'Longhi ..... F24H 3/004 165/130
5,938,527 A * 8/1999 Oshima ..... F24F 1/01 454/344
6,327,427 B1 * 12/2001 Burkett ..... F24H 3/062 392/369
6,589,111 B1 * 7/2003 Giroux ..... F24F 7/06 219/201
6,810,205 B2 * 10/2004 Kaplanis ..... H05B 3/008 219/220
6,828,529 B1 * 12/2004 Wu ..... F24H 3/0405 219/202
6,974,381 B1 * 12/2005 Walker ..... F24F 7/007 454/230
7,013,080 B1 * 3/2006 Kaplanis ..... F24C 7/065 219/220
7,158,716 B2 * 1/2007 Shapiro ..... F04D 17/04 392/365
7,508,671 B2 * 3/2009 Sauciuc ..... G06F 1/20 165/104.33
7,977,606 B2 * 7/2011 Adachi ..... H05B 3/50 219/202
8,097,867 B2 1/2012 Bar et al.
8,180,205 B2 * 5/2012 Yao ..... F24H 3/004 165/130
8,184,962 B2 * 5/2012 Zanolin ..... F24D 19/06 392/373
8,395,089 B2 * 3/2013 Bohlender ..... B60H 1/2225 219/202
8,755,678 B2 * 6/2014 Dykman ..... F24H 3/022 219/541
9,457,641 B2 * 10/2016 Pierron ..... H05B 3/141
9,863,663 B2 * 1/2018 Kohl ..... B60H 1/2225
10,036,660 B2 * 7/2018 Ishihara ..... G01F 1/363
2003/0132222 A1 * 7/2003 Bohlender ..... F24H 3/0405 219/504
2005/0056637 A1 * 3/2005 Bohlender ..... F24H 3/0429 219/536
2005/0126754 A1 * 6/2005 Hofmann ..... F28F 3/12 165/80.3
2008/0223841 A1 * 9/2008 Lofy ..... H05B 3/16 219/202
2008/0240689 A1 * 10/2008 Coke ..... F24H 3/0417 392/367
2009/0003808 A1 * 1/2009 Brooke ..... H05B 3/008 392/407
2009/0184267 A1 7/2009 Bar et al.
2009/0285567 A1 * 11/2009 Searle ..... F24H 3/0417 392/371
2010/0078425 A1 * 4/2010 Wang ..... F24H 3/004 219/538
2010/0096117 A1 * 4/2010 Seido ..... H01L 21/4878 165/185
2010/0200556 A1 * 8/2010 Gogmos ..... B60H 1/2225 219/202
2010/0220985 A1 9/2010 Eisenhauer et al.
2011/0056220 A1 * 3/2011 Caggiano ..... B01D 53/002 62/94
2012/0061379 A1 * 3/2012 Vempati Venkata ..... F24H 3/0405 219/553
2013/0020060 A1 * 1/2013 Moser ..... B21D 53/04 165/148
2013/0062336 A1 * 3/2013 Zhang ..... H05B 3/02 219/530
2013/0251353 A1 * 9/2013 Amberson ..... F24H 3/0411 392/365
2014/0217086 A1 * 8/2014 Bytzek ..... H05B 3/26 219/478
2015/0108111 A1 * 4/2015 Gries ..... F24H 3/0429 219/486
2015/0108112 A1 * 4/2015 Gries ..... F24H 3/0429 219/486
2015/0158407 A1 * 6/2015 Oh ..... B60N 3/104 219/432

(56) References Cited

U.S. PATENT DOCUMENTS

| | | | | |
|---|---|---|---|---|
| 2015/0168012 | A1* | 6/2015 | Amberson | F24H 3/0411<br>392/377 |
| 2015/0377496 | A1* | 12/2015 | Cho | F22B 1/28<br>62/79 |
| 2016/0161145 | A1* | 6/2016 | Zhang | H05B 3/06<br>392/355 |

FOREIGN PATENT DOCUMENTS

| | | | |
|---|---|---|---|
| JP | 2000168343 | A | 6/2000 |
| KR | 20040013558 | A | 2/2004 |

* cited by examiner

HEATING DEVICE

CROSS-REFERENCE TO RELATED APPLICATION

This application claims priority to European Application No. 15151236.5, having a filing date of Jan. 15, 2015, the entire contents of which are hereby incorporated by reference.

FIELD OF TECHNOLOGY

The following relates to a heating device.

BACKGROUND

Heating devices, in particular electrical heating devices, are well known. One example for a heating device is described in US 2010/0220985 A1. The known devices suffer from a poor degree of efficiency.

SUMMARY

An aspect relates to an improved heating device with increased efficiency.

A heating device is disclosed which comprises a housing having an opening and surrounding an interior space. A fan is arranged in proximity to the housing. A heating element is arranged in the housing. A heat distribution element is arranged in the housing and in proximity to the heating element. The heating element is adapted to generate heat. The heat distribution element is adapted to transfer the heat generated by the heating element to air in the interior space. The fan is adapted to provide a flow of air through the interior space of the housing such that the air is heated and the heated air leaves the housing through the opening.

The heat generated by the heating element is transferred to the air via the heat distribution element. By the heat distribution element, a large surface for transporting heat from the heating element to the air can be provided. The hot air is moved with the fan and leaves the heating device via the opening. Thus, the opening can be called an air outlet. By convection of the hot air, an area surrounding the heating device can be heated. In particular, the heating device is suitable for heating a room.

The fan can be a high performance centrifugal fan or an axial fan. The device may comprise several fans.

The opening can be formed in an upper region of the housing, for example at the top of the housing.

The device can be adapted to generated heat such that the air leaving the device has a temperature of 75° C. The overall capacity of air at this temperature can be 200 $m^3$/h.

The heating element can be an infrared heating element which is adapted to convert electrical energy into infrared radiation. Such infrared heating element is also called infrared heater. Essentially, it is a body with a higher temperature which transfers energy to a body with a lower temperature through electromagnetic radiation (infrared radiation). Depending on the temperature of the emitting body, the wavelength of the peak of the infrared radiation ranges from 780 nm to 1 mm. No contact or medium between the emitting body and the receiving body is needed for the energy transfer. The infrared heater can be operated in vacuum or in a medium, for example in air.

The infrared heating element can be a heat lamp or a quartz heat lamp.

A heat lamp is an incandescent light bulb that is used for the principal purpose of creating heat. The spectrum of black body radiation emitted by the lamp is shifted to produce more infrared light. The heat lamp may include a red filter to minimize the amount of visible light emitted. Further, the heat lamp may include an internal reflector.

A quartz heat lamp (or halogen lamp) is an incandescent lamp filled with highly pressurized halogen gas. The gas may be combined with a small amount of bromine or iodine which causes tungsten atoms to regenerate by lessening the evaporation of the filament. This leads to a much longer life of the halogen lamps. The halogen lamp may be made out of quartz glass which has a higher melting point than standard glass. The quartz heat lamp can be adapted to emit medium wave infrared energy. This makes it effective in systems where rapid heater response is required. A tubular infrared lamp in a quartz bulb may produce infrared radiation with wavelengths of 1.5-8 μm. The enclosed filament operates at around 2500 K, producing more shorter-wavelength radiation than open wire-coil sources. The quartz heat lamp can have a power of up to 600 W. The quartz heat lamp can have a length of up to 400 mm.

The infrared radiation can be confined to the interior space by the housing. In order to improve the confinement, the housing may have a reflective layer on its inner surface. The housing can comprise a metal or a metal alloy. The housing can be made completely from a metal or a metal alloy.

The heat distribution element is heated by absorbing the infrared radiation generated by the infrared heating element.

The heat distribution element can be formed such that it partially surrounds several regions of the interior space adjacent to the heating element. Hereby, a large region of the surface of the heat distribution device can be brought close to the heating element to improve the heat transfer.

In one embodiment, the heat distribution element can be formed with several sheets which are arranged along the heating element, wherein the sheets pairwise encircle an acute angle. In a side view, the sheets of the heat distribution element have a "Lamda" shape ("Λ") (the letter of the Greek alphabet). Alternatively, it can be called a "V" shape (with respect to the Latin alphabet). By adjusting the angle between the sheets and/or the size of the sheets the amount of heat absorbed by the heat distribution device can be determined.

For each sheet of the heat distribution element, a lower side of the sheet can be longer than an upper side of the sheet. This leads to a trapezoid shape of the sheet. Alternatively, for each sheet, a lower side of the sheet is as long as an upper side of the sheet leading to a rectangular shape.

In another embodiment, the heat distribution element may be formed as a plate having several slits. Each slit can be formed with an air guiding element. Two or more rows of slits can be arranged next to each other on the plate. The slits (and air guiding elements) can be arranged in a regular pattern on the plate, e.g. parallel to each other.

The heat distribution element may be formed as a perforated plate having several holes, wherein the perforated plate is essentially as long as the heating element. The perforated plate can be as long as the heating element. The perforated plate can be arranged inside the housing such that a lower end of the plate is arranged on one side of the housing and an upper side of the plate is arranged on another side of the housing, wherein the other side of the housing is opposite to the side of the housing.

In a further embodiment, the heat distribution element may be formed with several perforated plates, wherein the perforated plates pairwise encircle an acute angle. The perforated plates can be essentially (or exactly) as long as the heating element.

By providing any of the above disclosed configurations of the heat distribution device, the surface exposed to infrared radiation can be increased leading to a better transfer of heat. The heat distribution element can be provided with several sub-elements. Each sub-element can have a form as described for the heat distribution element. Two or more sub-elements can be arranged in proximity to the heating element, for example opposite to each other such that the heating element is arranged between two or more the sub-elements.

The heating device may comprise several heating elements which are arranged in the housing, wherein at least one heat distribution element is arranged in proximity of the heating elements. In addition, the heat distribution element can be formed with several sub-elements as described above. Each heating element can be surrounded by sub-elements of the heat distribution element.

The heat distribution element, its sheets and/or its sub-elements, if applicable, can be perforated such that several holes are formed in the heat distribution element. The holes can be arranged in a regular pattern. The holes in the heat distribution element can form a free space which is between 30% and 35%, and more particularly, for example, 32%, of the surface area of the heat distribution element.

The heat distribution element can comprise a metal or metal alloy. It can be made from a metal or metal alloy. Suitable materials for the heat distribution element are steel, copper and aluminum or a combination thereof.

The housing may comprise a further opening as an air inlet. The further opening may be formed at a lower portion of the housing, for example at a bottom side of the housing. The fan can be arranged below the housing. A duct of the fan can be smaller than the further opening of the housing. This allows an additional suction of air into the housing due to the Bernoulli Effect.

The housing and the fan can be surrounded by a further housing which can be called a shell. The housing and/or the shell can be formed in a cylindrical shape or a round/spherical ("organic") shape.

The heating device can further comprise a control circuit. The control circuit can be adapted to control the speed of the fan and/or the power of the heating element, in particular, the power of the infrared radiation. The heating device can be formed with a connection for connecting the device with a power supply. The control circuit can be configured to provide a sequence of control signals to control the time and/or duration for turning on the fan(s) and/or the heating element(s). The control circuit can be formed as a thermostat or as a circuit board having a processor and memory. The control circuit can be configured to connect with a router, for example by a wired or wireless connection, so the heater can be monitored and/or programmed by a smartphone application. Moreover, the control circuit can be integrated with sensors outside a house so that each heater can adapt its mode of operation according to the actual and/or predicted weather conditions.

BRIEF DESCRIPTION

Some of the embodiments will be described in detail, with reference to the following figures, wherein like designations denote like members, wherein.

DETAILED DESCRIPTION

In the figures, like reference signs are used for like components.

Figure 1:
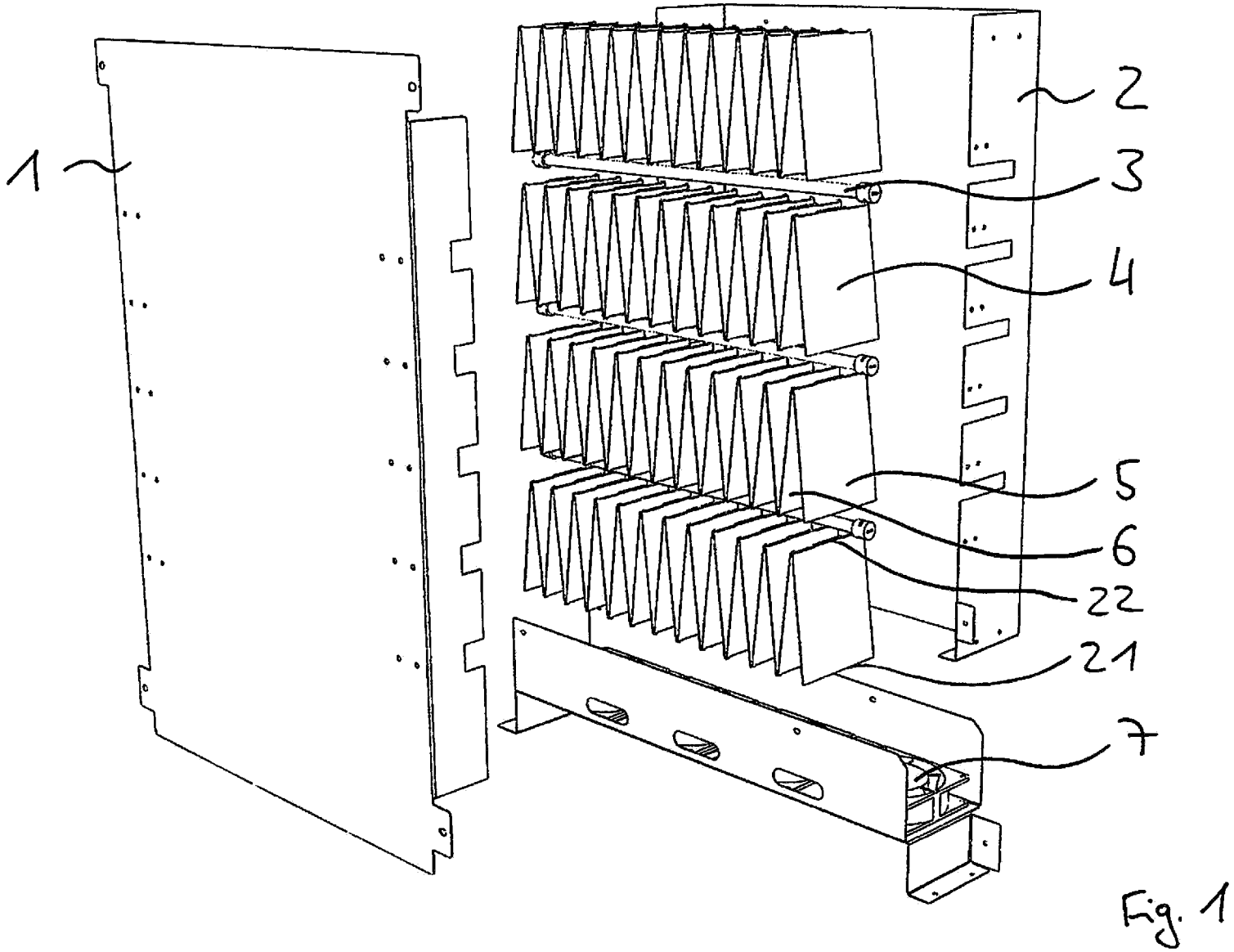
FIG. 1 shows an explosive view of a first embodiment of a heating device.
Figure 2:
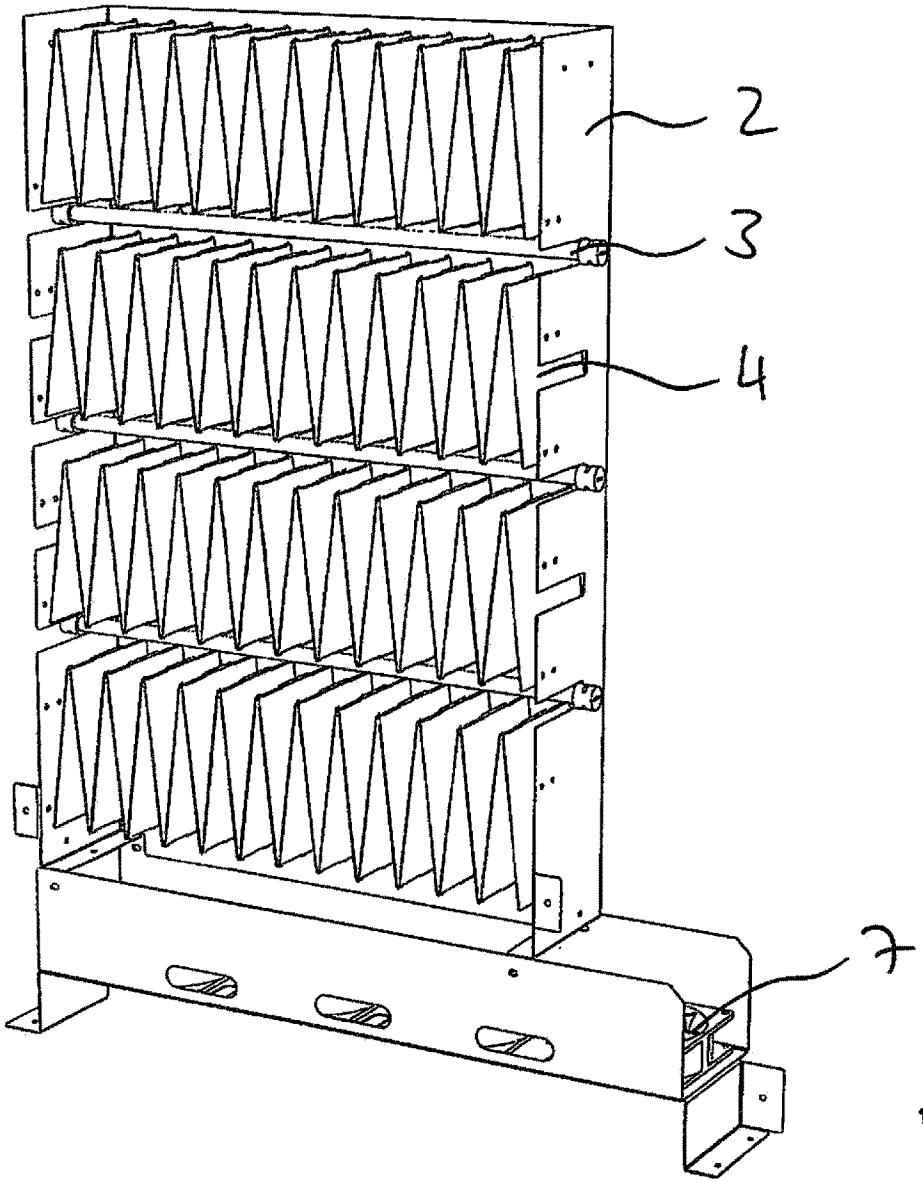
FIG. 2 shows another perspective of the embodiment shown in FIG. 1.
Figure 3:
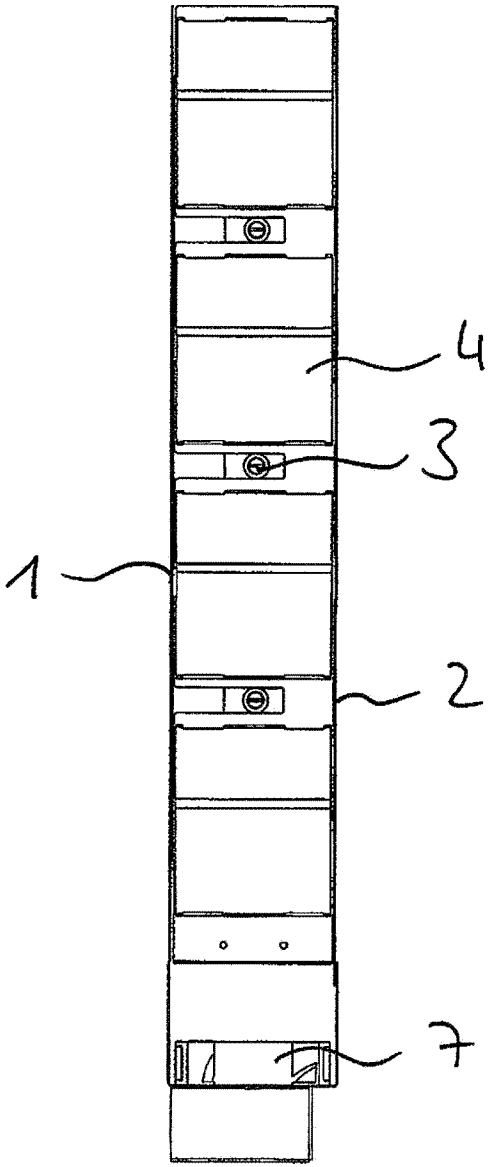
FIG. 3 shows a cross section of the embodiment shown in FIG. 1.

FIG. 1 shows a first embodiment of a heating device. A housing is formed by a first housing element 1 and a second housing element 2. In the housing, heating elements 3 are arranged, for example quartz lamps. Above and below the heating elements 3, heat distribution elements 4 are arranged. Sheets 5, 6 of the heat distribution element 4 encircle an acute angle. A lower side 21 of the heat distribution element is as long as an upper side 22. Alternatively, the lower side 21 can be longer than the upper side 22. The cross section of the heat distribution element 4 resembles the Greek capital letter "Lambda" (Λ).

Below the housing, an axial fan 7 is arranged. The fan 7 drives air through the interior of the housing. The air enters the housing through a lower opening in the bottom side of the housing. By moving upwards inside the housing, the air is in contact with the heating elements 3 and the heat distribution element 4. The warm air leaves the housing through an opening at the upper side.

The air enters the housing from below. It moves to the lower side 21 of the heat distribution element 4. Here, the air slows down because the moving area widens. By slowing down the air, the heat distribution element 4 is more efficient in conducting heat from the heating element to the air. The air passes the heating element 3 and leaves the heat distribution element 4 through the upper side 22. The heat distribution element 4 can be perforated.

Figure 4:
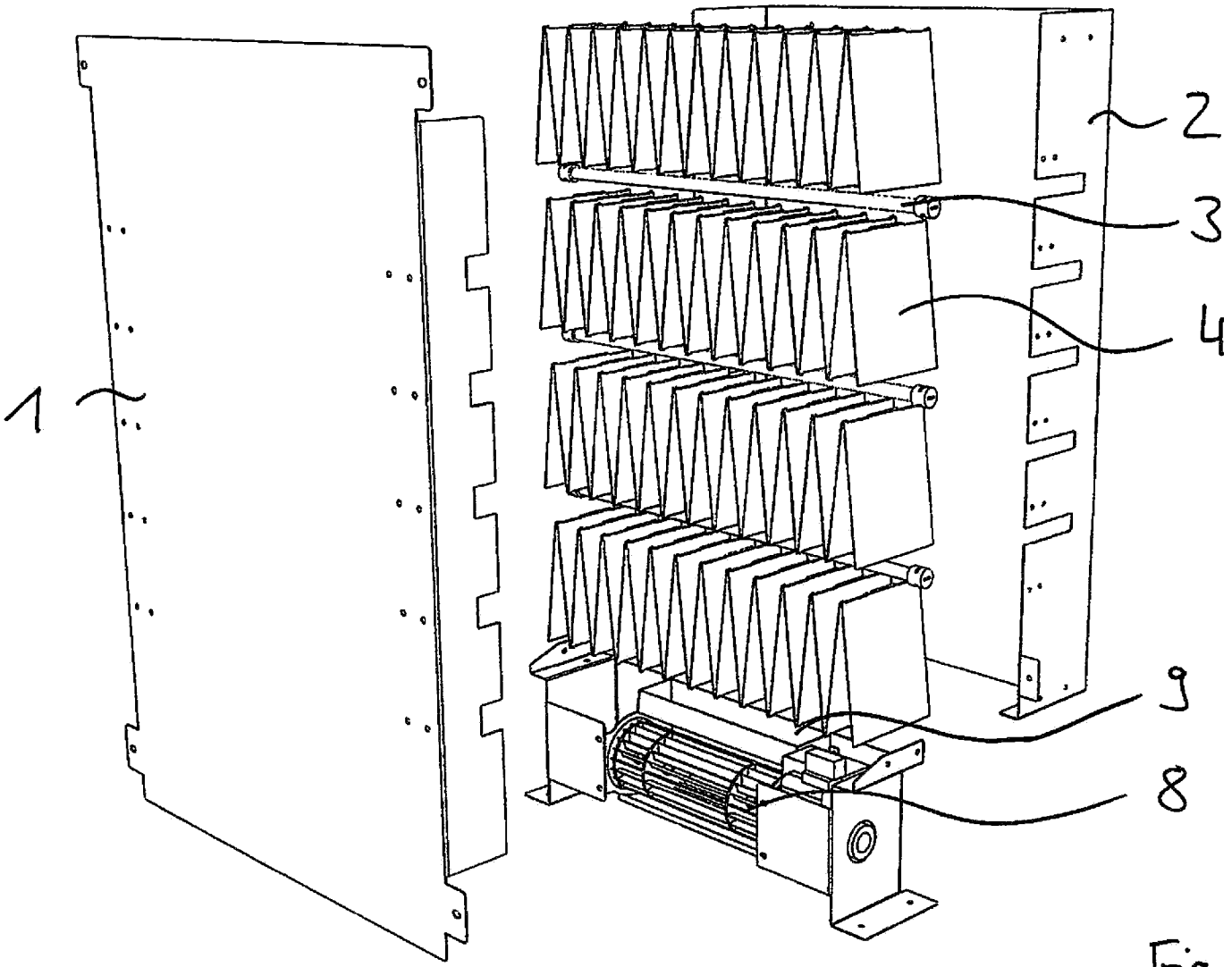
FIG. 4 shows an explosive view of a second embodiment of a heating device.
Figure 5:
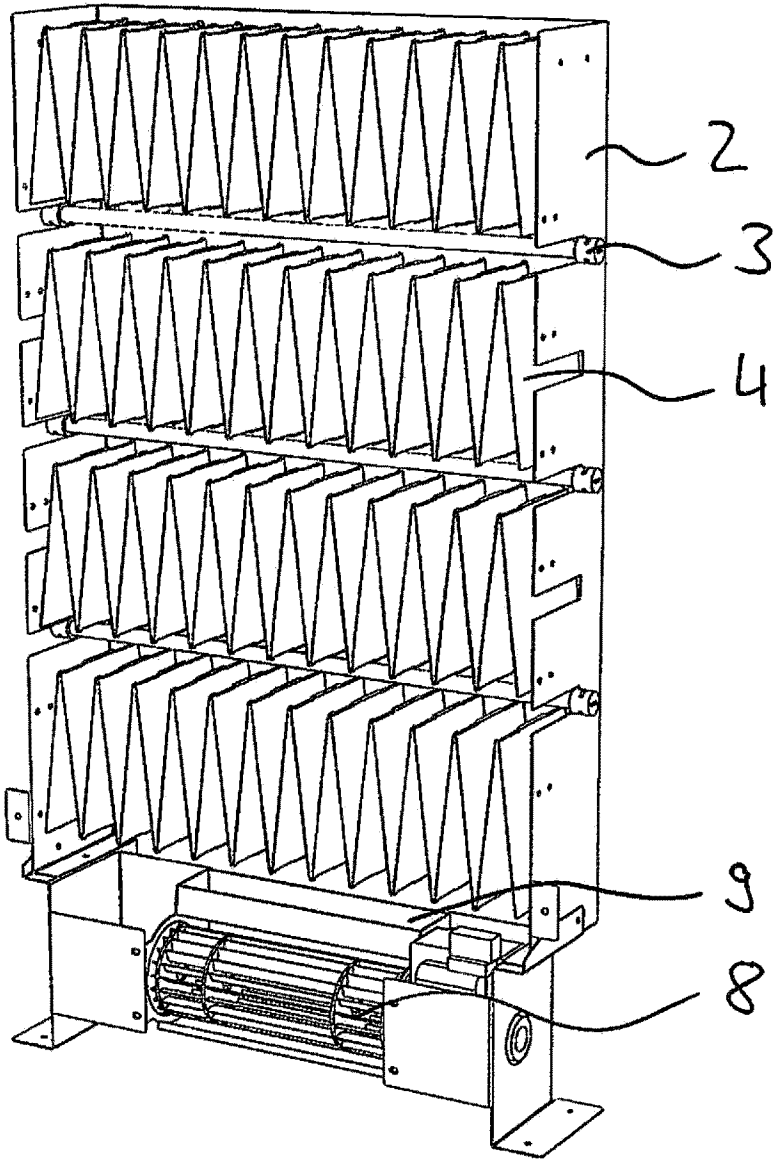
FIG. 5 shows another perspective of the embodiment shown in FIG. 4.
Figure 6:
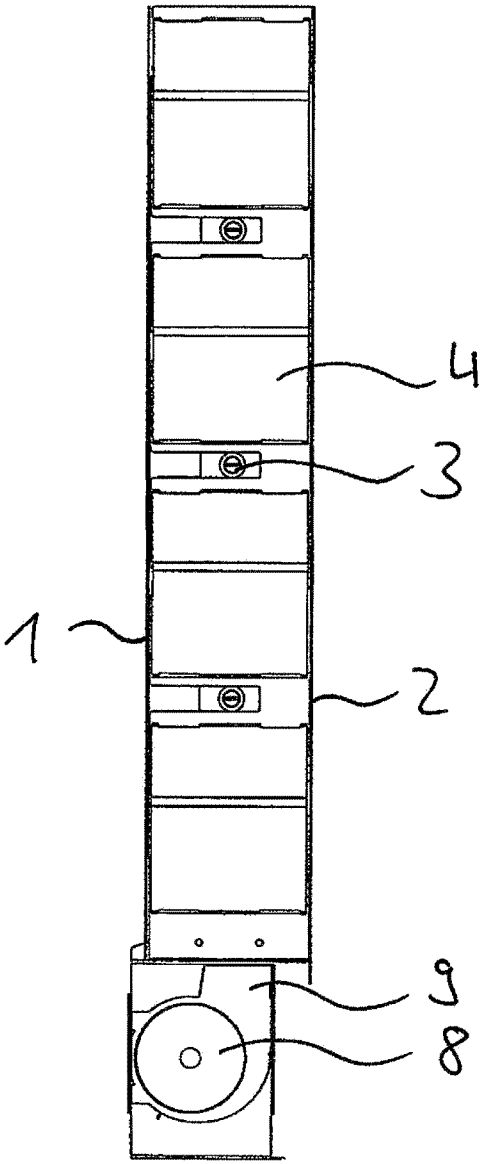
FIG. 6 shows a cross section of the embodiment shown in FIG. 4.

FIG. 4 shows a second embodiment of the heating device. Below the housing a centrifugal fan 8 with a duct 9 is arranged. The other components are identical to the embodiment of FIG. 1.

Figure 7:
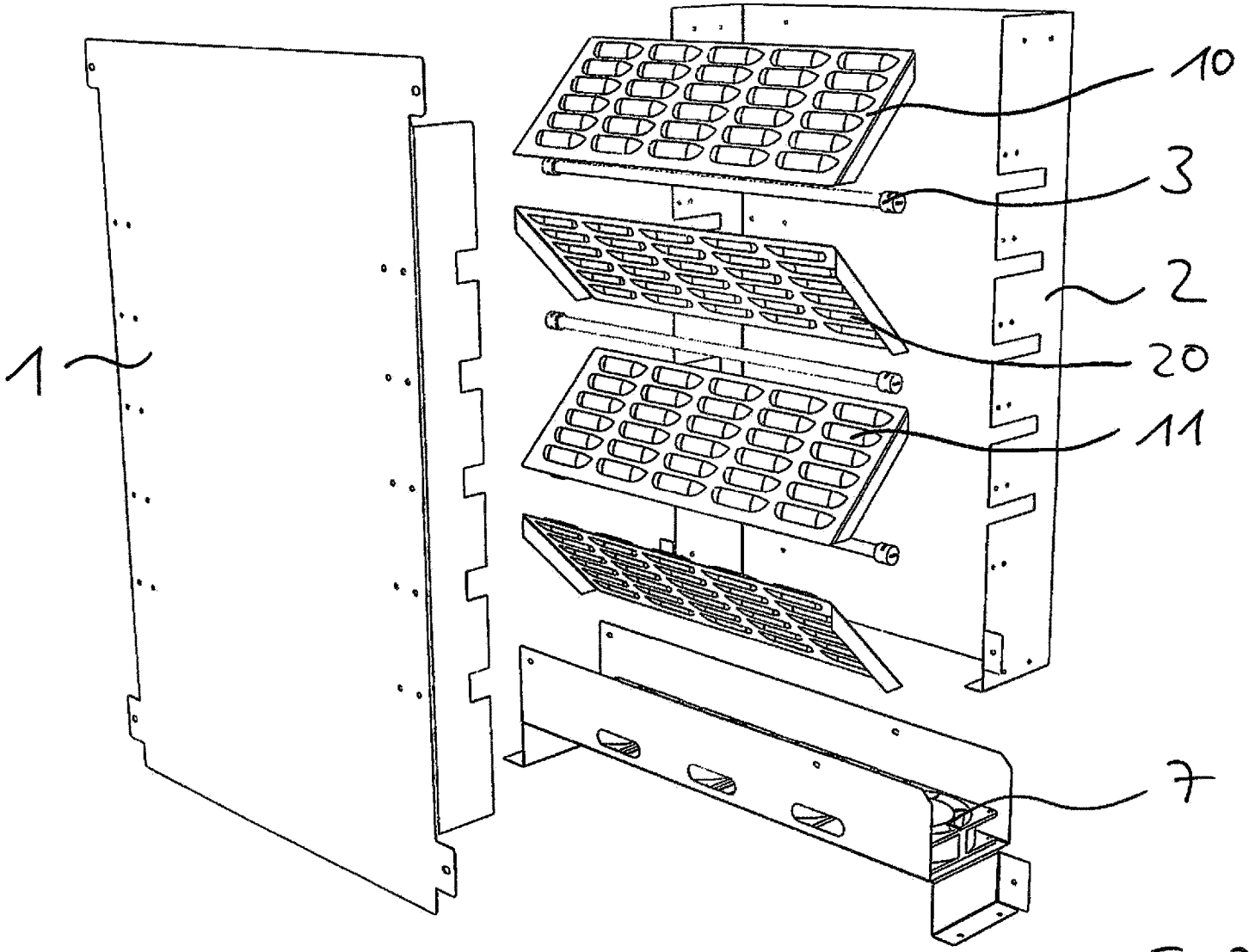
FIG. 7 shows an explosive view of a third embodiment of a heating device.
Figure 8:
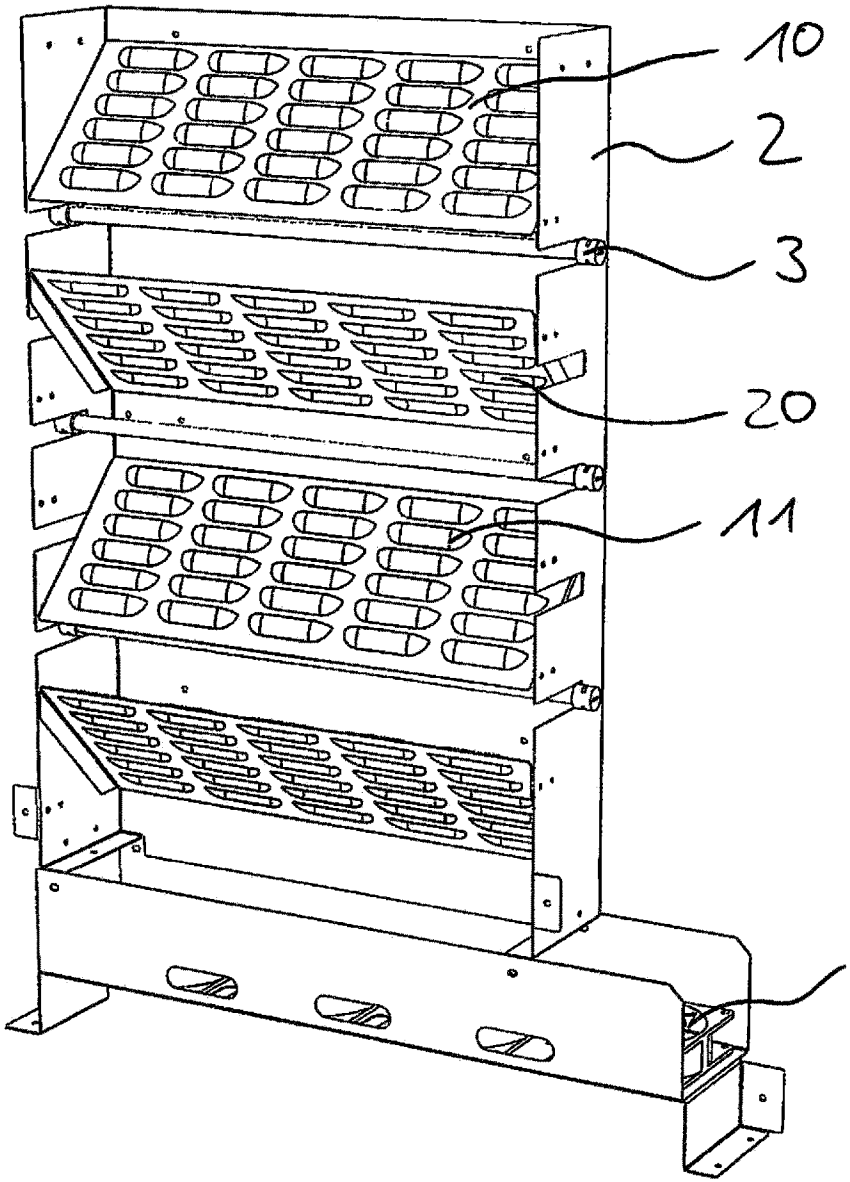
FIG. 8 shows another perspective of the embodiment shown in FIG. 7.
Figure 9:
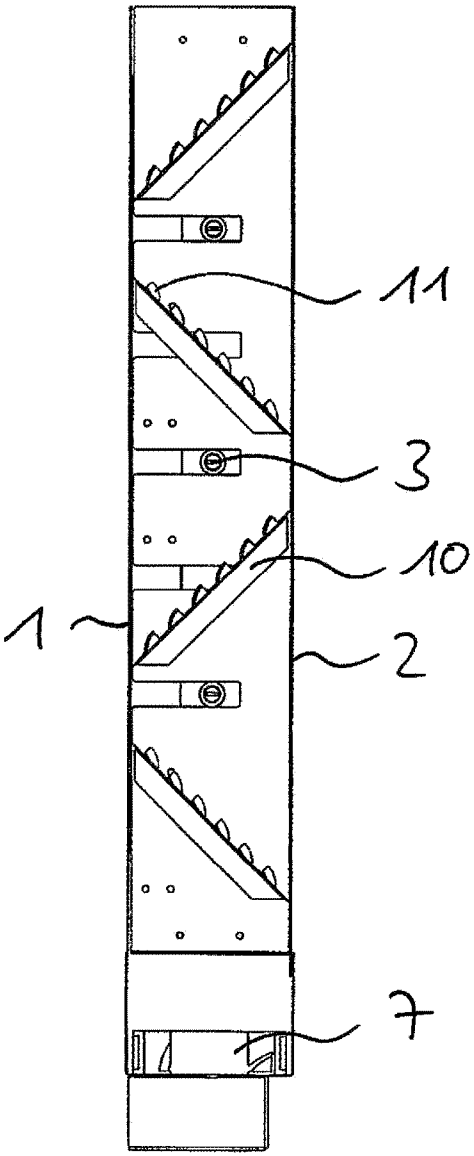
FIG. 9 shows a cross section of the embodiment shown in FIG. 7.

A third embodiment is shown in FIG. 7. The heat distribution element 10 is formed as a plate having several slits 20. Each slit 20 is formed with an air guiding element 11.

The slits 20 are arranged in a regular pattern, in particular the slits are arranged parallel to each other.

Figure 10:
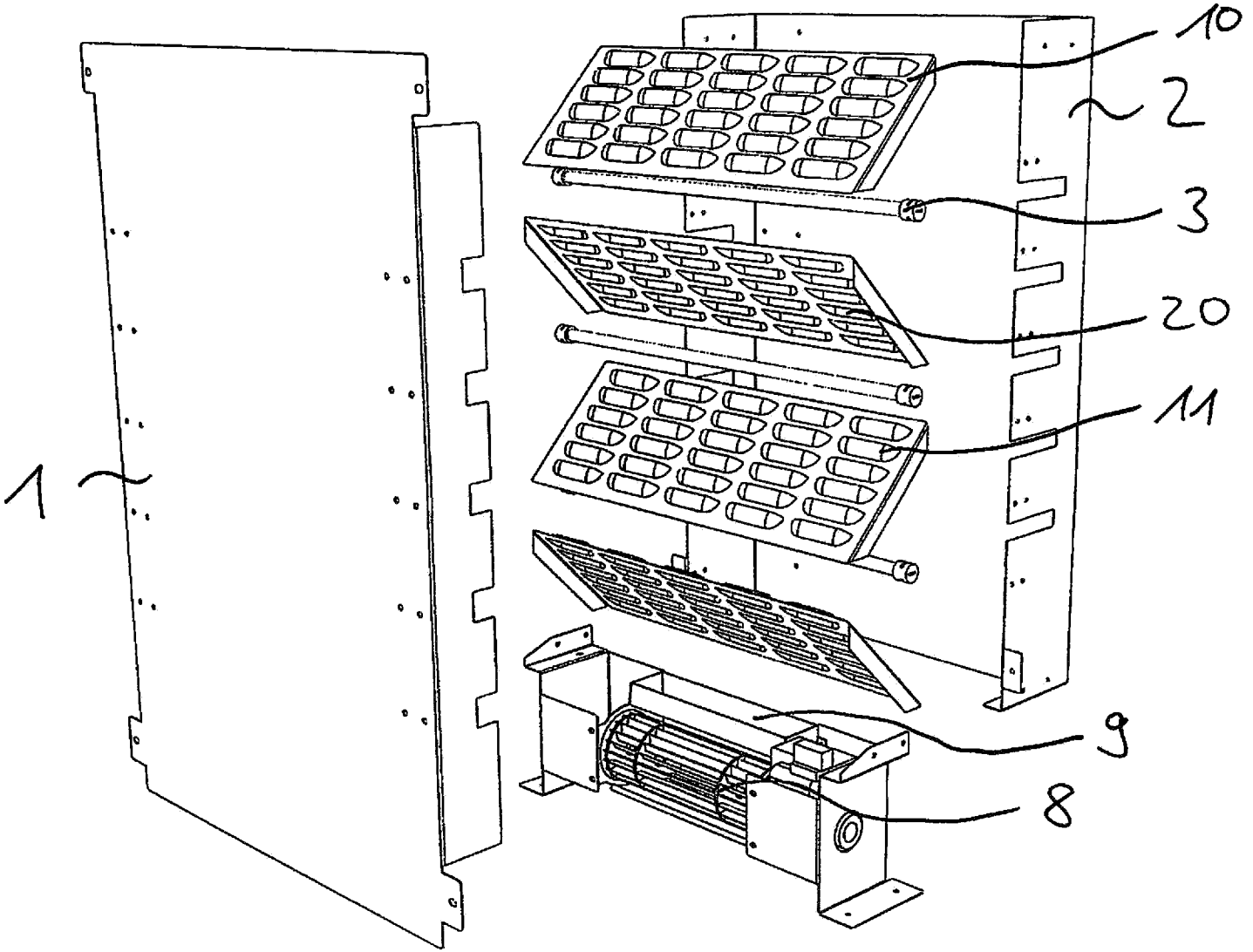
FIG. 10 shows an explosive view of a fourth embodiment of a heating device.
Figure 11:
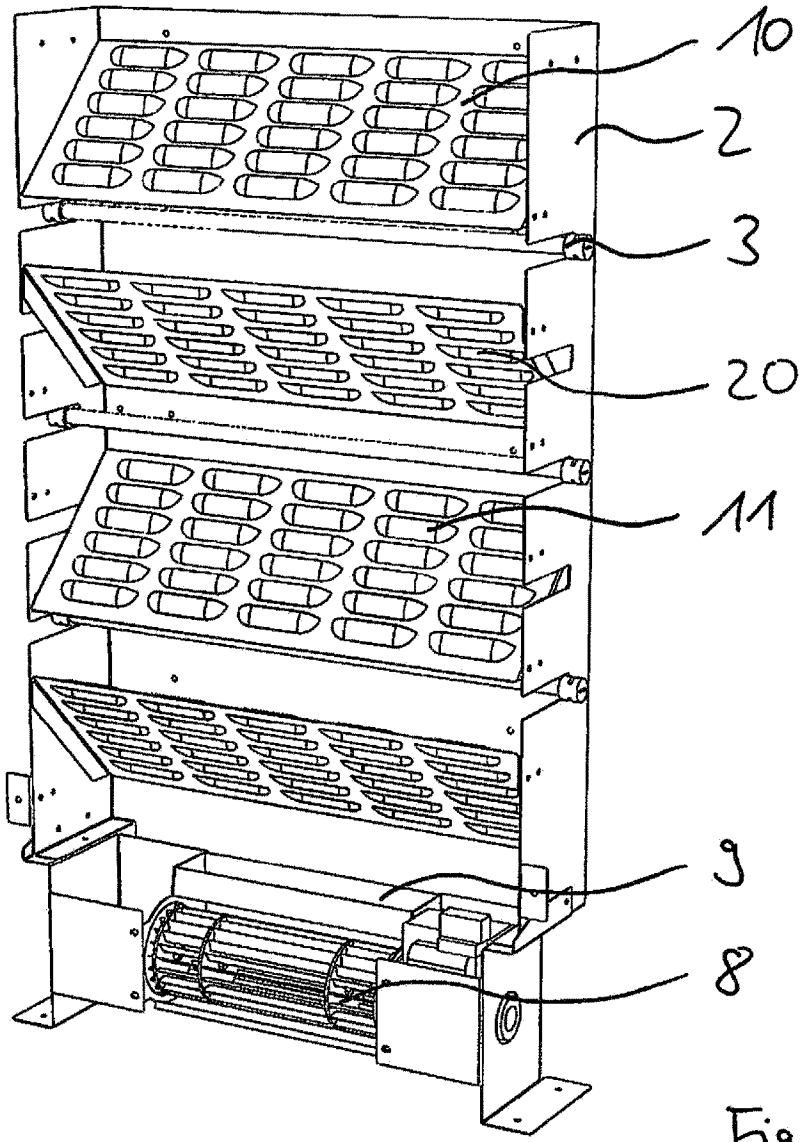
FIG. 11 shows another perspective of the embodiment shown in FIG. 10.
Figure 12:
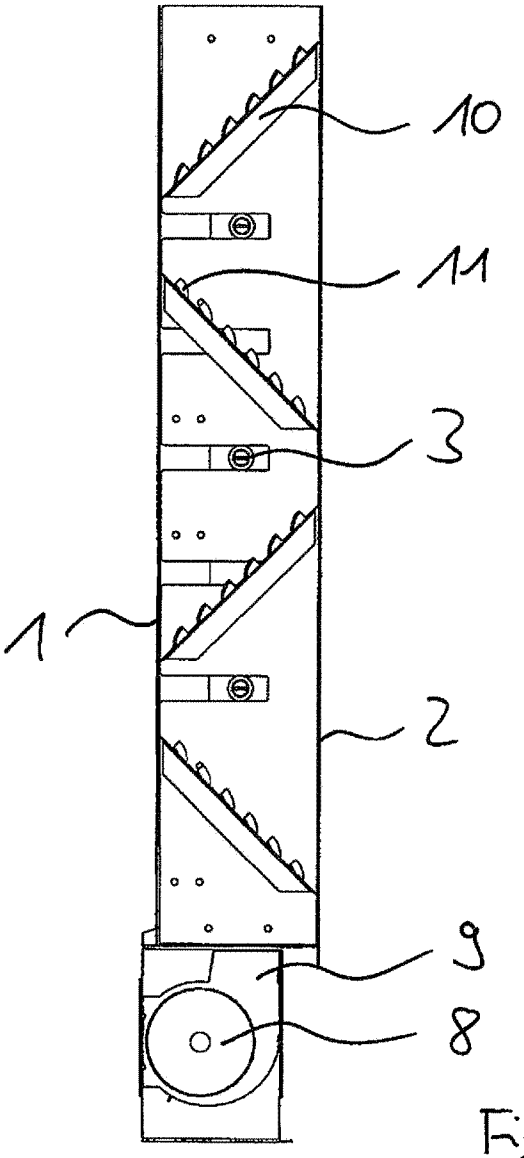
FIG. 12 shows a cross section of the embodiment shown in FIG. 10.

FIG. 10 shows a fourth embodiment of the heating device with plate-like heat distribution elements 10 and a centrifugal fan 8.

Figure 13:
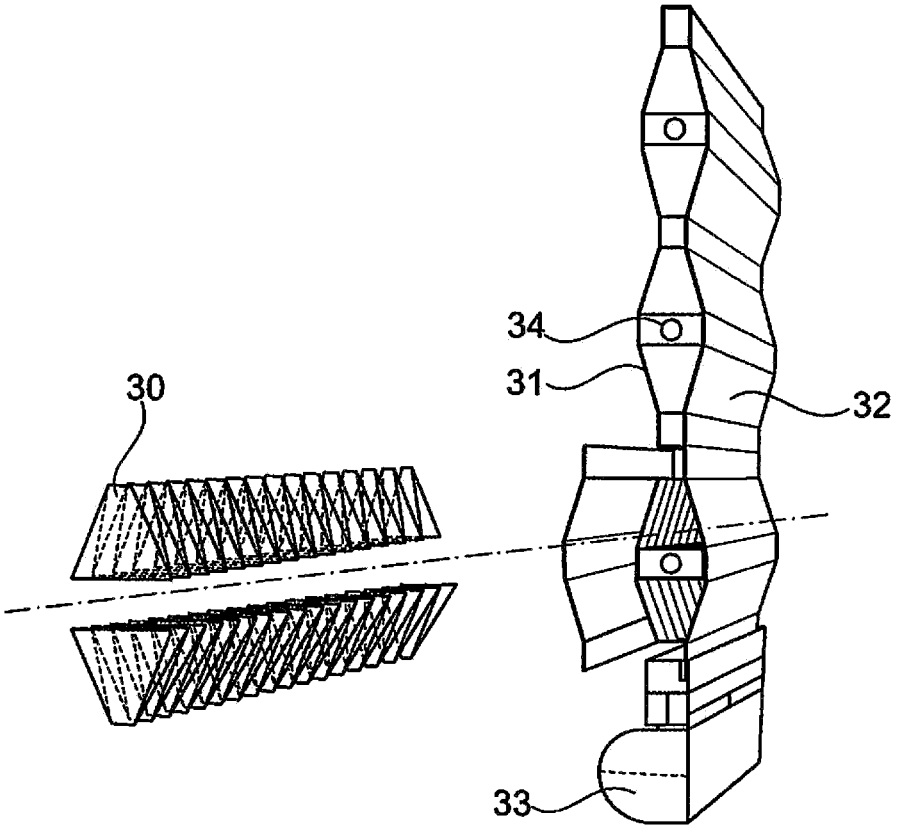
FIG. 13 shows another embodiment of the heat distribution element.

FIG. 13 shows another embodiment of a heat distribution element 30. The heat distribution element 30 is enclosed on two sides by corrugated plates 31, 32. The corrugated plates 31, 32 allow to steer the air more efficiently inside the housing (not shown). Further, a heating element 34 and a fan 33 are provided.

Figure 14:
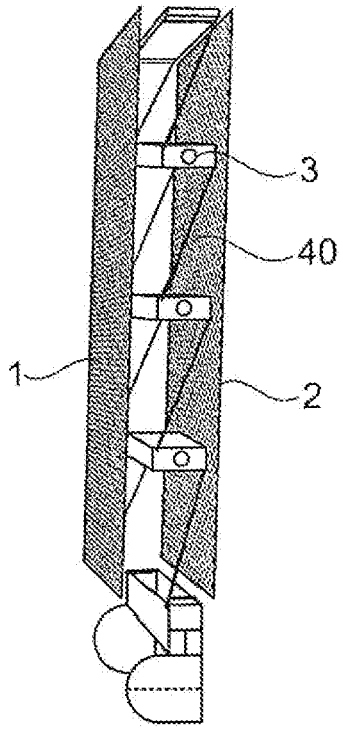
FIG. 14 shows still another embodiment of the heat distribution element.
Figure 14:
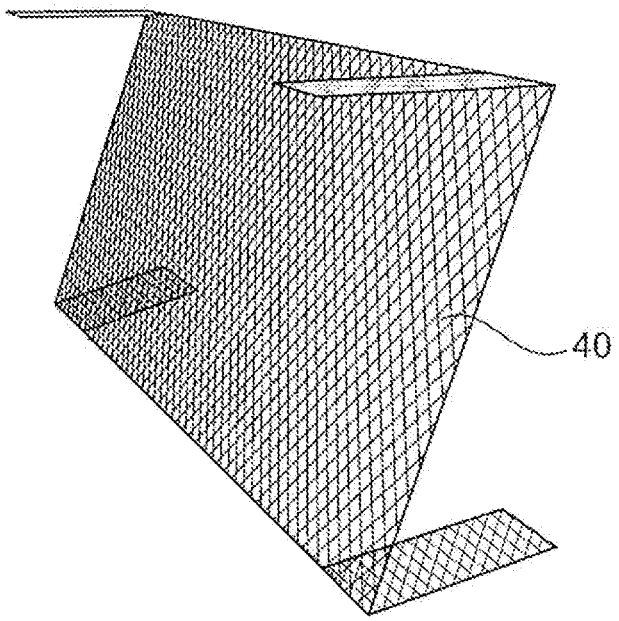

The heat distribution element 40 shown in FIG. 14 is formed as perforated plate with a length essentially as long as the length of the heating element 3. The perforated plate 40 is arranged slanted in the housing, namely between the first housing element 1 and the second housing element 2.

Figure 15:
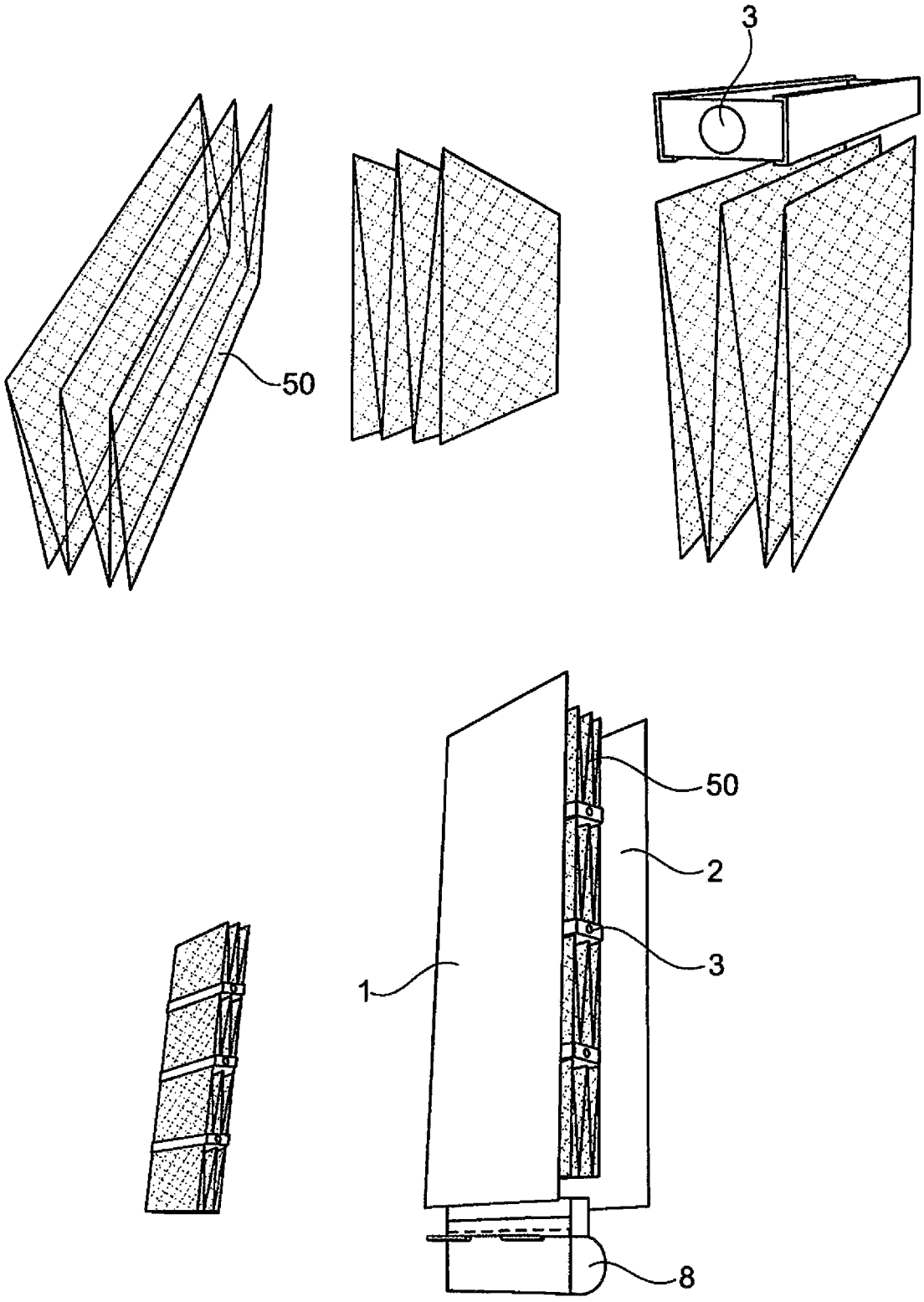
FIG. 15 shows a further embodiment of the heat distribution element.

In FIG. 15, a further heat distribution element 50 is shown. In this embodiment, the heat distribution element 50 is formed by several perforated plates which pairwise encircle an acute angle.

All features disclosed in the specification, the claims and the figures can be relevant either alone or in any particular combination with each other.

The invention claimed is:

1. A heating device comprising:

a housing having an opening and surrounding an interior space, wherein the housing includes a reflective surface is on an inner surface of the housing, such that infrared radiation is confined to the interior space, a fan arranged in proximity to the housing, a heating element arranged in the housing, and a heat distribution element arranged in the housing and in proximity to the heating element, the heat distribution element being perforated by several holes that are formed in the heat distribution element and evenly distributed across the heat distribution element, wherein the several holes forming perforations on the heat distribution element define a free space that is free of other elements, wherein:

the heating element is adapted to generate heat, the heat distribution element is adapted to transfer the heat generated by the heating element to air in the interior space, and the fan is adapted to provide a flow of air through the interior space of the housing such that the air is heated and the heated air leaves the housing through the opening;

wherein the heat distribution element is formed with several perforated plates, wherein the perforated plates pairwise encircle an acute angle.

2. The heating device of claim 1, wherein the heat distribution element is formed such that the heat distribution element partially surrounds several regions of the interior space adjacent to the heating element.

3. The heating device of claim 1, wherein the heat distribution element is formed with several sheets which are arranged along the heating element, wherein the sheets pairwise encircle an acute angle.

4. The heating device of claim 3, wherein, for each sheet, a lower side of the sheet is longer than an upper side of the sheet.

5. The heating device of claim 3, wherein, for each sheet, a lower side of the sheet is as long as an upper side of the sheet.

6. The heating device of claim 1, wherein the heat distribution element is formed as a plate having several slits.

7. The heating device of claim 6, wherein each slit is formed with an air guiding element.

8. The heating device of claim 1, wherein the heat distribution element is formed as a perforated plate having several holes, and wherein the perforated plate is essentially as long as the heating element.

9. The heating device of claim 1, wherein the perforated plates are essentially as long as the heating element.

10. The heating device of claim 1, wherein the heating element is an infrared heating element which is adapted to convert electrical energy into infrared radiation.

11. The heating device of claim 1, comprising several heating elements which are arranged in the housing, wherein at least one heat distribution element is arranged in proximity to the heating elements.

12. The heating device of claim 1, wherein the fan is arranged below the housing, and wherein the housing comprises a further opening as an air inlet.

* * * * *